US010544908B2

(12) United States Patent
Gielen

(10) Patent No.: US 10,544,908 B2
(45) Date of Patent: Jan. 28, 2020

(54) LIGHTING DEVICE

(71) Applicant: SIGNIFY HOLDING B.V., Eindhoven (NL)

(72) Inventor: Vincent Stefan David Gielen, Gastel (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/317,559

(22) PCT Filed: Jul. 3, 2017

(86) PCT No.: PCT/EP2017/066476
§ 371 (c)(1),
(2) Date: Jan. 13, 2019

(87) PCT Pub. No.: WO2018/010992
PCT Pub. Date: Jan. 18, 2018

(65) Prior Publication Data

US 2019/0293243 A1 Sep. 26, 2019

(30) Foreign Application Priority Data

Jul. 14, 2016 (EP) ..... 16179512

(51) Int. Cl.

| | |
|---|---|
| ***F21K 9/232*** | (2016.01) |
| ***F21K 9/235*** | (2016.01) |
| ***F21V 29/70*** | (2015.01) |
| ***F21K 9/237*** | (2016.01) |
| ***F21V 3/02*** | (2006.01) |
| *F21Y 115/10* | (2016.01) |
| *F21K 9/90* | (2016.01) |
| *F21V 23/00* | (2015.01) |

(Continued)

(52) U.S. Cl.
CPC ..... *F21K 9/232* (2016.08); *F21K 9/235* (2016.08); *F21K 9/237* (2016.08); *F21V 3/02* (2013.01); *F21V 29/70* (2015.01); *F21K 9/90* (2013.01); *F21V 3/061* (2018.02); *F21V 23/009* (2013.01); *F21Y 2101/00* (2013.01); *F21Y 2115/10* (2016.08)

(58) Field of Classification Search
CPC ..... F21K 9/232; F21K 9/235; F21K 9/237; F21V 29/70
See application file for complete search history.

(56) References Cited

FOREIGN PATENT DOCUMENTS

| | | | |
|---|---|---|---|
| CN | 103322460 | A | 9/2013 |
| CN | 103982872 | A | 8/2014 |

(Continued)

*Primary Examiner* — Joseph L Williams
(74) *Attorney, Agent, or Firm* — Daniel J. Piotrowski

(57) ABSTRACT

Lighting device (10), comprising: a glass bulb (12); a tubular flare (14) having an open distal and (30*a*), provided inside the glass bulb (12) and joined with the glass bulb (12); a cylindrical heat spreader (20) having a first section (32*a*) arranged inside the tubular flare (14) and a second section (32*b*) extending outside the tubular flare (14) and the glass bulb (12); a solid-state lighting unit (18) mounted on top of the first section (32*a*); an optical means (16) provided over the solid state lighting unit (18); said open distal end (30*a*) being arranged for positioning the optical means (16) outside the tubular flare (14); a driver (24) provided at least partly inside the cylindrical heat spreader (20) and electrically connected to the solid-state lighting unit (18); and an end cap (26) attached to the second section (32*b*) of the cylindrical heat spreader (20).

10 Claims, 3 Drawing Sheets

(51) Int. Cl.
*F21V 3/06* (2018.01)
*F21Y 101/00* (2016.01)

(56) References Cited

FOREIGN PATENT DOCUMENTS

| | | | |
|---|---|---|---|
| CN | 203893037 | U | 10/2014 |
| WO | 2015177038 | A1 | 11/2015 |
| WO | 2016012467 | A1 | 1/2016 |

LIGHTING DEVICE

This application is the U.S. National Phase application under 35 U.S.C. § 371 of International Application No. PCT/EP2017/066476, filed on Jul. 3, 2017 which claims the benefit of European Patent Application No. 16179512.5, filed on Jul. 14, 2016. These applications are hereby incorporated by reference herein.

FIELD OF THE INVENTION

The present invention relates to a lighting device, such as an LED (light emitting diode) candle lamp. The present invention also relates to a method of manufacturing such a lighting device.

BACKGROUND OF THE INVENTION

There are currently many LED candle lamps on the market that try to mimic the look and feel of the incandescent candle lamps. All current LED candle lamps, with the exception of LED filament bulbs, have some sort of interface part between the bulb and the end cap. However, this compromises the look and feel of an incandescent look-alike.

CN103322460 discloses an LED candle lamp comprising a lamp holder, a drive power source, a lamp support, the LED light source module and a lamp shade. The lamp holder is fixedly connected with the lamp support. The drive power source is arranged in an inner cavity of the lamp support. The LED light source module is fixed at the front end of the lamp support. The lamp shade is sleeved on the periphery face of the lamp support and surrounds the LED light source module and the lamp support. However, a problem with the LED candle lamp in CN103322460 is that it is not makeable in glass, at least not with high volume production methods, because of the gradually thicker cross section of the lamp shade towards the lamp support (see FIG. 3 in CN103322460).

In WO2015/177038 a solid state lighting device is disclosed with an inner envelope and an outer envelope. The solid state light sources are positioned in the inner envelope. The space in between the inner and outer envelope forms a cavity that acts as a heat pipe for transporting the heat generated by the solid state light sources from the inner envelope to the outer envelope from which it is transmitted to the ambient.

WO 2016/012467 discloses a solid state lighting device with light transmissive heat pipe configured to dissipate thermal energy from the light source. The heat pipe comprises a flexible conduit configured as wick.

SUMMARY OF THE INVENTION

It is an object of the present invention to overcome or at least alleviate the aforementioned problems, and to provide an improved lighting device.

According to a first aspect of the invention, this and other objects are achieved by a lighting device, comprising: a glass bulb; a tubular flare provided inside the glass bulb and joined with the glass bulb; a cylindrical heat spreader having a first section arranged inside the tubular flare and a second section extending outside the tubular flare and the glass bulb; a solid-state lighting unit mounted on top of the first section of the cylindrical heat spreader; a driver provided at least partly inside the cylindrical heat spreader and electrically connected to the solid-state lighting unit; and an end cap attached to the second section of the cylindrical heat spreader.

The glass bulb and tubular flare of the present lighting device can easily be manufactured on a standard incandescent bulb production line. The tubular flare, which may be a standard size extruded (therefore very smooth and accurate) glass tube, also allows for a good interface—both mechanically and thermally—with the heat spreader. And the glass bulb does not have to be glued to a separate part which in turn connects it to the end cap. Instead, the cylindrical heat spreader sticking out from the bulb/flare is simply pressed into the end cap. Overall, the present lighting device is such that it can be made on existing GLS lines, which makes it not only cheap and lightweight, but it also very much may look like GLS lamps.

The glass bulb may have a distal top and a proximal base relative to the end cap, wherein the tubular flare has a distal end and a proximal end relative to the end cap, and wherein the proximal end of the tubular flare is joined with the proximal base of the glass bulb. The tubular flare may for example be melted or sealed to the glass bulb, similar to incandescent bulbs, but with the pump tube and stem wires left out. The tubular flare may hence stand-alone inside the glass bulb without being attached to the glass bulb except at said proximal end. In other words, the tubular flare may be freestanding inside the glass bulb.

The glass bulb may have uniform or substantially uniform wall thickness. 'Substantially uniform' may here mean that the wall thickness may vary up to ±45%. The wall thickness may be in the range of 0.35-1.00 mm, for example.

The end cap may about the joint glass bulb and tubular flare. Hence, the transition between end cap and glass bulb may be smooth and very much like in a GLS lamp with no intermediate part.

The end cap may be attached to the second section of the cylindrical heat spreader such that the cylindrical heat spreader has a direct thermal connection to the end cap. This may increase the thermal performance of the lighting device.

The lighting device may further comprise a driver insulator provided between the cylindrical heat spreader and the driver. The driver insulator may be an inner dielectric coating or separate electrical insulator, for example. The driver insulator can be cheaply produced by, e.g. thermoforming.

The lighting device may further comprise optical means provided over the solid-state lighting unit. The optical means may be selected from the group consisting of total internal reflection optics, a diffuser, and a toroid reflector, and combinations thereof, such as a TIR toroidal optic or TIR optic with a diffusive part/surface. The solid-state lighting unit could also be vertically arranged.

The lighting device may be a candle lamp, for example an LED candle lamp.

According to a second aspect of the invention, there is provided a method of manufacturing a lighting device, which method comprises: providing a glass bulb; melting a tubular flare into the glass bulb; providing an assembly comprising a cylindrical heat spreader with a first section and a second section, a solid-state lighting unit mounted on top of the first section, and a driver provided at least partly inside the cylindrical heat spreader and electrically connected to the solid-state lighting unit; inserting the assembly into the tubular flare such that the first section is arranged inside the tubular flare and the second section extends outside the tubular flare and the glass bulb; and pressing the second section of the cylindrical heat spreader into an end cap. This aspect may exhibit the same or similar features and technical effects as the first aspect, and vice versa.

As mentioned above, the glass bulb and tubular flare can easily be manufactured on a standard incandescent bulb line. A gripper may be used, replacing the pump tube, so that the flare can be sealed to the bulb on the existing lines.

It is noted that the invention relates to all possible combinations of features recited in the claims.

BRIEF DESCRIPTION OF THE DRAWINGS

These and other aspects of the present invention will now be described in more detail, with reference to the appended drawings showing embodiment(s) of the invention.

As illustrated in the figures, the sizes of layers and regions may be exaggerated for illustrative purposes and, thus, are provided to illustrate the general structures of embodiments of the present invention. Like reference numerals refer to like elements throughout.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
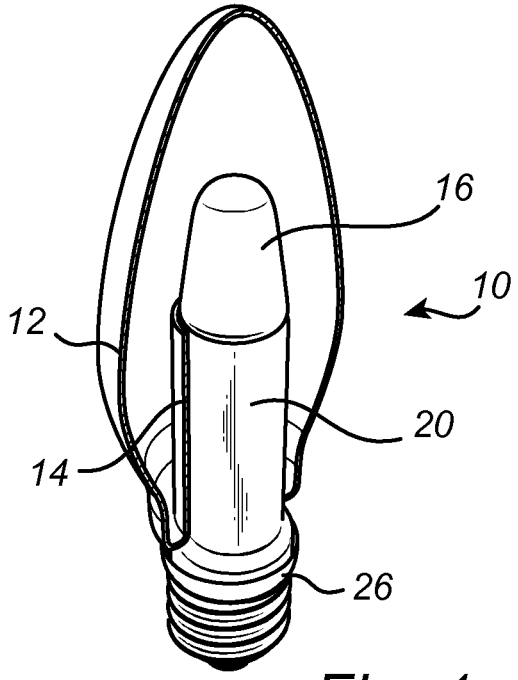
FIG. 1 is a partly cross-sectional perspective view of a lighting device according to an embodiment of the present invention.
Figure 2:
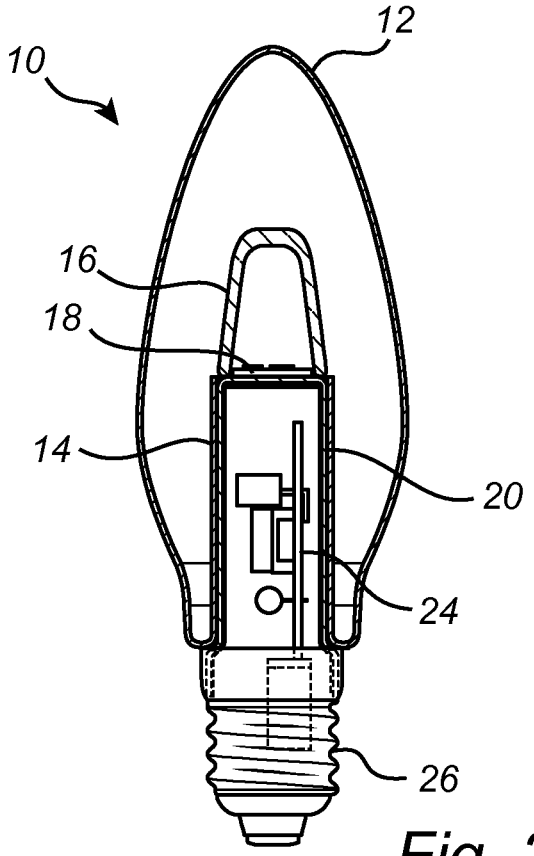
FIG. 2 is a cross-sectional side view of the lighting device of FIG. 1.
Figure 3:
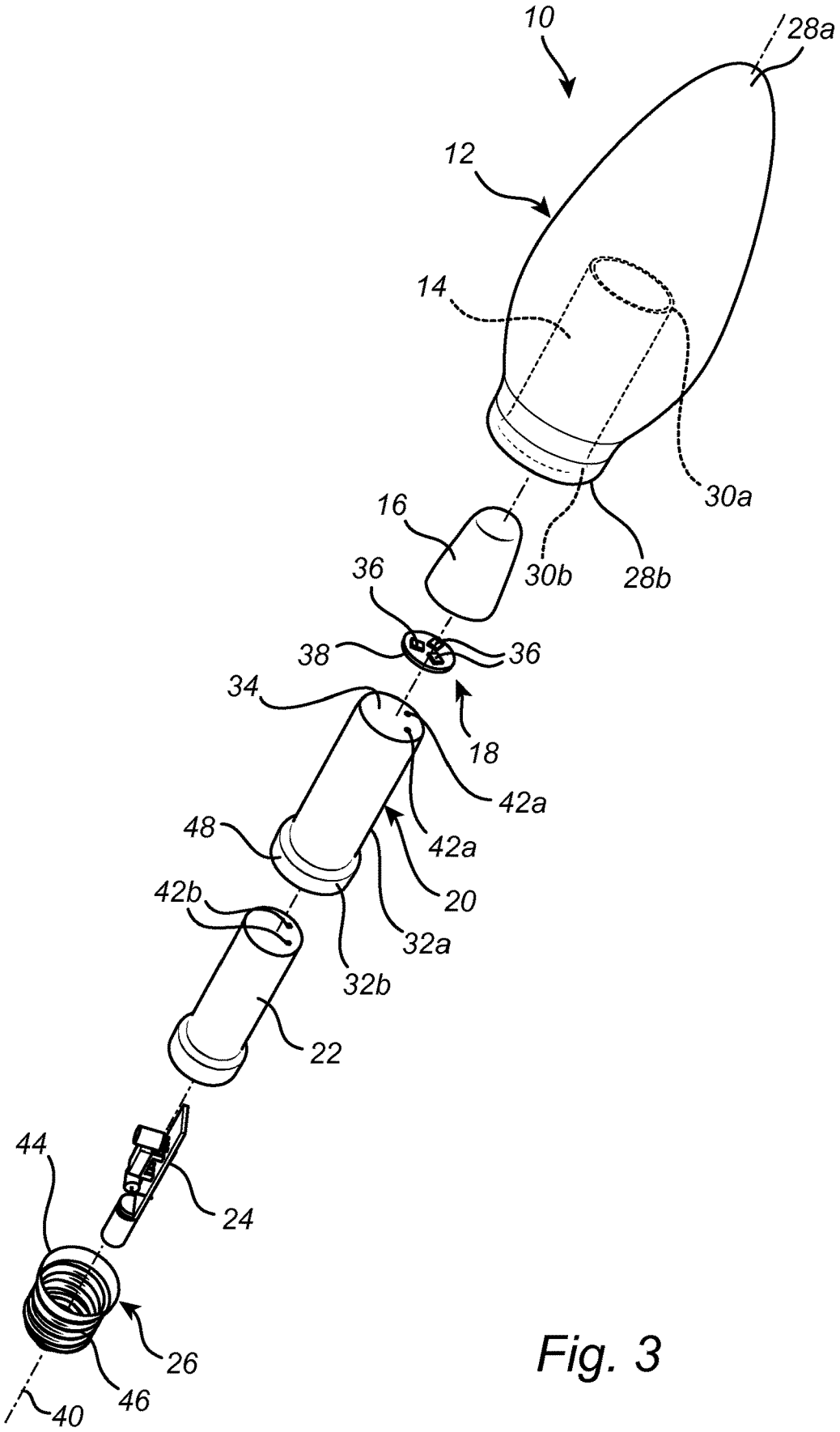
FIG. 3 is an exploded perspective view of the lighting device of FIG. 1.

FIGS. 1-3 illustrate a lighting device 10 according to an embodiment of the present invention. The lighting device 10 in FIGS. 1-3 is an LED (light emitting diode) candle lamp. The lighting device 10 may be a retrofit lamp.

From top to bottom as seen in FIG. 3, the lighting device 10 comprises a glass bulb 12 with a tubular flare 14, optical means 16, a solid-state lighting (SSL) unit 18, a heat spreader 20, a driver insulator 22, a driver 24, and an end cap 26.

Figure 4:
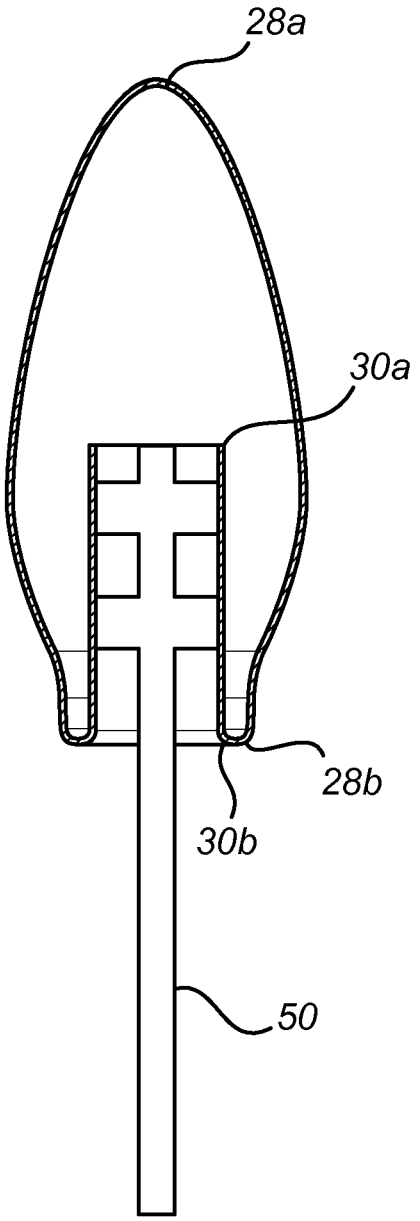
FIG. 4 illustrates a step during manufacturing of the present lighting device.

The glass bulb 12 is candle-shaped ("B-shape"). The glass bulb 12 could be clear or frosted. The glass bulb 12 can be made by blowing glass in a mold. The wall of the glass bulb 12 is thin and (substantially) uniform. The wall thickness of the glass bulb 12 may for example be in the range of 0.35-1.00 mm. The glass bulb 12 has a distal top (or tip) 28*a* and a proximal base 28*b* relative to the end cap 26 (see also FIG. 4). This means that the base 28*b* is closer to the end cap 26 than the top 28a.

The tubular flare 14 may be a glass tube, in particular a standard size extruded glass tube. The tubular flare 14 has an open distal end 30*a* and a proximal end 30*b* relative to the end cap 26. Like above, this means that the end 30*b* is closer to the end cap 26 than the end 30*a*.

The proximal end 30*b* of the tubular flare 14 is joined with the proximal base 28*b* of the glass bulb 12. The tubular flare 14 and the glass bulb 12 may for example be melted together at the proximal end 30*b*/proximal base 28*b*, like in incandescent bulbs, but without any pump tube or stem wires. The tubular flare 14 hence is freestanding, i.e. it is standing alone inside the glass bulb 12 without being attached to the glass bulb 12 except at said proximal end 30*b*.

The heat spreader 20 is cylindrical. The heat spreader 20 can for example be deep drawn from highly thermally conductive sheet metal, such as aluminum. Alternatively the heat spreader 20 could be cold forged, for example. The heat spreader 20 comprises a first section 32*a* and a second section 32*b*. The top of the first section of 32*a* is closed, forming a top surface 34. The second section 32*b* may have a larger outer diameter than the first section 32*a*. The first section 32*a* of the heat spreader 20 may match the interior of the tubular flare 14, and is arranged inside the tubular flare 14. The first section 32*a* of the heat spreader 20 may for example be glued to the tubular flare 14. The top surface 34 of the first section 32*a* of the heat spreader 20 may be in level with the distal end 30*a* of the tubular flare 14, as can be seen in FIG. 2. To this end, the tubular flare 14 and the first section 32*a* of the heat spreader 20 may have the same or substantially the same length. The second section 32*b* of the heat spreader 20, on the other hand, extends outside (or below) the tubular flare 14 and glass bulb 12, as also seen in FIG. 2.

The SSL unit 18 is generally adapted to emit light. The SSL unit 18 is mounted on top of the first section 32*a* of the heat spreader 20, i.e. on the top surface 34. The SSL unit 18 can be mounted to the heat spreader 20 by use of thermally conductive (non-electrical insulative) paste, for optimal thermal performance. The SSL unit 18 may comprise one or more SSL elements 36 acting as light sources. The SSL elements 36 may for example be LEDs. The SSL unit 18 may also comprise a printed circuit board 38, such as a metal-core printed circuit board (MCPCB), on which the one or more SSL elements 36 are mounted. In the illustrated embodiment, the SSL unit 18 is horizontally arranged, i.e. the PCB 38 is transversal to the longitudinal axis 40 of the lighting device 10.

The optical means 16 is provided over the SSL unit 18. The optical means 16 in the illustrated embodiment is a TIR (total internal reflection) optic. The TIR optic may be shaped like a cone with a blunt tip. The TIR optic could be injection molded. The TIR optic serves to distribute light emitted by the SSL elements 36 towards the side and also downwards, towards the end cap 26, which is beneficial for a candle lamp. The TIR optic could be replaced by a diffuser or a toroid reflector, for example.

In an alternative embodiment (not shown), the SSL unit 18 could be vertically arranged, to create a more omnidirectional distribution and not requiring an optic to bring the light downwards, although a diffuser may be beneficial to reduce glare or spottiness.

The driver 24 is generally adapted to regulate the power to the SSL unit 18. The driver 24 may also contain electronics necessary for dimming, connectivity, etc. The driver 24 is provided at least partly inside the heat spreader 20. The driver insulator 22 may be provided between the heat spreader 20 and the driver 24. The driver insulator 22 may be shaped like a cylinder, with a closed top. The driver insulator 22 may for example be an inner dielectric coating on the heat spreader 20, or a separate electrical insulator. The driver insulator 22 can be thermoformed. The driver 24 is electrically connected to the SSL unit 18. To this end, holes 42*a*, 42*b* may be provided in the top of the heat spreader 20 and the driver insulator 22, respectively, through which holes 42*a*, 42*b* electrical conductors between the driver 24 and SSL unit 18 may pass.

The end cap 26 is generally adapted to mechanically and electrically connect the lighting device 10 to an external socket (not shown). The end cap 26 may have a mantel 44 and an external threading 46. The end cap can be of the type E14. The end cap 26 may for example be an aluminum end cap. The end cap 26 is attached to the circumferential outer surface 48 of the second section 32*b* of the heat spreader 20. The cylindrical heat spreader 20 may have a direct thermal connection to the end cap 26. This enables heat sinking through the end cap 26 through conduction, rather than just heat dissipation through convection at the outer surface of the bulb 12/tubular flare 14. It is also a cost efficient way to make a strong stable connection between heat spreader 20 and end cap 26 without any intermediate part(s). The second section 32*b* of the heat spreader 20 may for example be pressed into the mantle 44 of the end cap 26. Hence, the end cap 26 may be press fitted to the heat spreader 20. The end cap 26 may about the proximal end of the joint glass bulb 12 and tubular flare 14, i.e. at 28*b*/30*b*. In this way, the transition between the end cap 26 and the glass bulb 12 may be smooth.

In use, the lighting device 10 is fitted in an external socket, and power is supplied from the external socket via the end cap 26 and the driver 24 to the SSL unit 18, so that light is emitted. Heat generated when the lighting device 10 is on may be dissipated partly through conduction to the end cap 36 (max 5%), partly through radiation (less than 40%), and the rest through convection by the ambient air.

In the following, a method of manufacturing the present lighting device 10 is described. The method comprises providing the glass bulb 12. The tubular flare 14 is then melted into glass bulb, similarly as in incandescent bulbs, but without any pump tube or stem wires. Instead, during glass processing, a gripper 50 may be used to replace the pump tube, see FIG. 4. The method also comprises providing an assembly, or "puck", which comprises the cylindrical heat spreader 20, the SSL unit 18 mounted on the heat spreader 20, and the driver 24 inside the heat spreader 20. The assembly may also comprise at least one of the optical means 16 and the driver insulator 22. The assembly then is inserted and glued into the tubular flare 14 after the tubular flare 14 has been melted into the glass bulb 12. Thereafter, the heat spreader 20 is pressed into the end cap 26. In particular, the second section 32*b* of the heat spreader 20 is pressed into the mantle 42 of the end cap 26.

Figure 5:
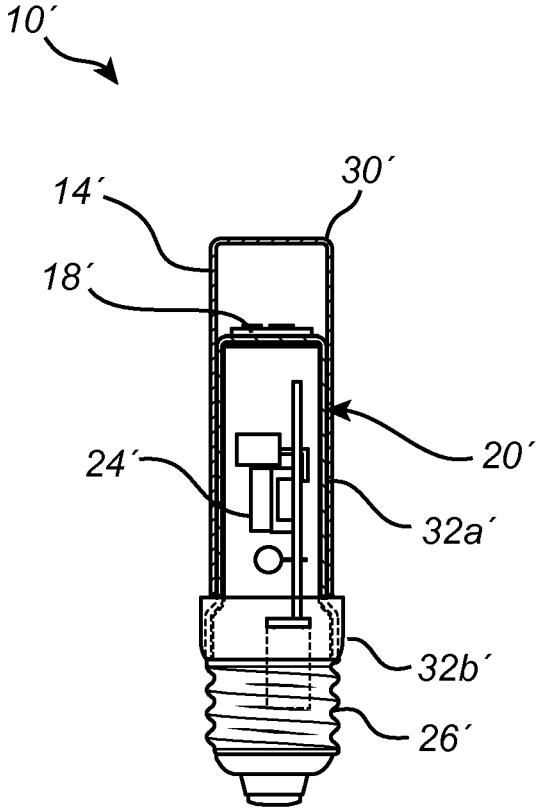
FIG. 5 is a partly cross-sectional side view of another lighting device.

FIG. 5 discloses another lighting device 10' similar to the lighting device 10, but without the glass bulb 12. The lighting device 10' comprises: a tubular flare 14'; a cylindrical heat spreader 20' having a first section 32*a*' arranged inside the tubular flare and a second section 32*b*' extending outside the tubular flare; a solid-state lighting unit 18' mounted on top of the first section of the cylindrical heat spreader; a driver 24' provided at least partly inside the cylindrical heat spreader and electrically connected to the solid-state lighting unit; and an end cap 26' attached to the second section of the cylindrical heat spreader. The proximal end 30*a*' of the tubular flare 14' is closed.

The person skilled in the art realizes that the present invention by no means is limited to the preferred embodiments described above. On the contrary, many modifications and variations are possible within the scope of the appended claims.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A lighting device, comprising:

an end cap;

a glass bulb having a distal top and a proximal base relative to the end cap;

a tubular flare having an open distal end and a proximal end relative to the end cap, provided inside the glass bulb and joined with the glass bulb;

a cylindrical heat spreader having a first section arranged inside the tubular flare and a second section extending outside the tubular flare and the glass bulb;

a solid-state lighting unit mounted on top of the first section of the cylindrical heat spreader;

an optical means provided over the solid state lighting unit; said open distal end being arranged for positioning the optical means outside the tubular flare;

a driver provided at least partly inside the cylindrical heat spreader and electrically connected to the solid-state lighting unit; and wherein the end cap attached to the second section of the cylindrical heat spreader, and wherein the proximal end of the tubular flare is joined with the proximal base of the glass bulb.

2. A lighting device according to claim 1, wherein the tubular flare is standing alone inside the glass bulb without being attached to the glass bulb except at said proximal end.

3. A lighting device according to claim 1, wherein the glass bulb has uniform or substantially uniform wall thickness.

4. A lighting device according to claim 1, wherein the end cap abuts the joint glass bulb and tubular flare.

5. A lighting device according to claim 1, wherein the end cap is attached to the second section of the cylindrical heat spreader such that the cylindrical heat spreader has a direct thermal connection to the end cap.

6. A lighting device according to claim 5, wherein the optical means is selected from the group consisting of a total internal reflection optic, a diffuser, and a toroid reflector, and combinations thereof.

7. A lighting device according to claim 1, further comprising a driver insulator provided between the cylindrical heat spreader and the driver.

8. A lighting device according to claim 1, wherein the lighting device is a candle lamp.

9. A method of manufacturing a lighting device, which method comprises:

providing an end cap and a glass bulb, said glass bulb having a distal top and a proximal base relative to the end cap melting a tubular flare having an open distal end and a proximal end relative to the end cap into the glass bulb;

providing an assembly comprising a cylindrical heat spreader with a first section and a second section, a solid-state lighting unit mounted on top of the first section, an optical means provided over the solid state lighting unit; and a driver provided at least partly inside the cylindrical heat spreader and electrically connected to the solid-state lighting unit;

inserting the assembly into the tubular flare such that the first section is arranged inside the tubular flare and the second section extends outside the tubular flare and the glass bulb; whereby the optical means are positioned outside the tubular flare and pressing the second section of the cylindrical heat spreader into an end cap, and joining the proximal end of the tubular flare with the proximal base of the glass bulb.

10. A lighting device, comprising:

an end cap;

a tubular flare having a closed distal end and a proximal end relative to the end a cylindrical heat spreader having a first section arranged inside the tubular flare and a second section extending outside the tubular flare;

a solid-state lighting unit mounted on top of the first section of the cylindrical heat spreader;

a driver provided at least partly inside the cylindrical heat spreader and electrically connected to the solid-state lighting unit; and wherein the end cap attached to the second section of the cylindrical heat spreader, and wherein the proximal end of the tubular flare is joined with the proximal base of the glass bulb.

* * * * *